US005695195A

United States Patent [19]

John et al.

[11] Patent Number: 5,695,195

[45] Date of Patent: Dec. 9, 1997

[54] FRAME

[75] Inventors: Michel John, 64 Curvy Road, Blairgowrie, Randburg, 2194; Anthony Robin Clausen, Wadeville Ext.; Edward Joseph Khoury, Alberton, all of South Africa

[73] Assignees: Michel John, Randburg, South Africa; Peter Clive Mulroney, Perth, Australia

[21] Appl. No.: 666,524

[22] PCT Filed: May 18, 1995

[86] PCT No.: PCT/GB95/01120

§ 371 Date: Aug. 26, 1996

§ 102(e) Date: Aug. 26, 1996

[87] PCT Pub. No.: WO95/32031

PCT Pub. Date: Nov. 30, 1995

[30] Foreign Application Priority Data

Nov. 8, 1994 [ZA] South Africa ..... 94/8818
Mar. 9, 1995 [ZA] South Africa ..... 95/1957

[51] Int. Cl.[6] ..... A63B 63/00

[52] U.S. Cl. ..... 273/400; 473/478

[58] Field of Search ..... 273/398–402, 273/406, 407, 411, 26 A, 127 B, 395, 396; 473/197

[56] References Cited

U.S. PATENT DOCUMENTS 4,702,478 10/1987 Kruse ..... 273/127 B
5,244,213 9/1993 Armell ..... 273/400
5,346,227 9/1994 Amram et al. ..... 273/400
5,413,340 5/1995 Potvin et al. ..... 273/127 B
5,433,433 7/1995 Armell ..... 273/400

FOREIGN PATENT DOCUMENTS 2485379 12/1981 France ..... 273/400

*Primary Examiner*—Mark S. Graham
*Attorney, Agent, or Firm*—Burns, Doane, Swecker & Mathis, L.L.P.

[57] ABSTRACT

A goalpost comprises a frame 10 on which is located a net 38. The frame 10 is movable between an assembled position as shown and a folded position, and comprises six lengths of tubing 12, 14, 16, 18, 20, 22, each length of tubing having a first end and a second end, the second end of the first length of tubing being connected to the first end of the second length of tubing and so on with the second end of the nth length of tubing being connected to the first end of the first length of tubing to form a closed circuit; a connector 24, 26, 28, 30, 32, 34 between each of the first end of a length of tubing and the second end of an adjacent length of tubing, the connectors being designed to permit two adjacent lengths of tubing to be arranged at a first angle to each other in the assembled position of the frame as shown and a second angle to each other in the folded position of the frame; and tensioning means, such as a continuous elastic cord, between each pair of adjacent lengths of tubing to hold the lengths of tubing and the connectors in position in the assembled position of the frame and to permit the frame to be moved between its assembled position and its folded position.

11 Claims, 7 Drawing Sheets

FRAME

BACKGROUND TO THE INVENTION

THIS invention relates to a frame which is movable between an assembled position and a folded position, particularly a frame which may be used, when covered with a net, as a goalpost, or the like.

One of the most popular sports in the world is football or soccer. Many children and adults would like to be able to play soccer either in their gardens or on other pieces of land not laid out as regular soccer pitches, but one difficulty in this regard is the provision of a suitable goalpost. Generally soccer goalposts are rigid structures which take up a fair amount of space. Certain types of collapsible goalposts have been proposed as set out below.

U.S. Pat. No. 5,244,213

This reference discloses a collapsible sports goal where the various segments of the poles forming the goal are held together by an elastic cord. The elastic cord is not tensioned to hold the segments together, rather, the segments are held together by connector sleeves.

U.S. Pat. No. 4,664,384

This reference discloses a goal frame which includes a pair of front upright members which are coil springs, and a rigid connecting upper transverse member.

U.S. Pat. No. 3,979,120

This reference discloses a goal frame which includes a number of tubular frame members which are connected to each other to form the frame by means of helical spring connectors.

German Patent No. 2900190

This reference discloses a goal post which consists of two uprights supporting a horizontal cord. The uprights each consist of an upper rod fixed in an elastic base. The tension in the cord can be adjusted by altering the elastic elements of the base.

European Patent No 176317

This reference discloses a goal post assembly comprising two uprights, a crossbar and supports assembled from releasably interconnected sections using corner pieces. Each upright or crossbar may be made from a number of sections. At each joint between sections there is provided a spring which permits removal of one section from the end of its neighbour but not total separation.

French Patent No 2485379

This reference discloses a folding sports goal made from tubular elements, each element have a conical end designed to fit in a conical bore in an adjacent element, and joined by an elastic cord. The uprights and the crossbar are formed from a number of tubular elements which are held together by two elastic cords. One end of each cord is attached to a spring which the other end of each cord includes a ring which attaches to a hook to hold the tubular elements in position.

There is however a need for a goalpost for soccer, street-hockey, hockey, water polo, and other games which can be easily assembled and then disassembler when not needed, and which is easy to store and easy to use.

SUMMARY OF THE INVENTION

According to a first aspect of the invention there is provided a frame movable between an assembled position and a folded position which comprises:

a number n of lengths of tubing, each length of tubing having a first end and a second end, the second end of the first length of tubing being connected to the first end of the second length of tubing, the second end of the second length of tubing being connected to the first end of the third length of tubing and so on with the second end of the nth length of tubing being connected to the first end of the first length of tubing to form a closed circuit, each length of tubing forming a side of the frame;

a connector between each of the first end of a length of tubing and the second end of an adjacent length of tubing, the connectors being adapted to permit two adjacent lengths of tubing to be arranged at a first angle to each other in the assembled position of the frame and at a second angle to each other in the folded position of the frame; and tensioning means between each pair of adjacent lengths of tubing adapted to hold the lengths of tubing and the connectors in position in the assembled position of the frame and to permit the frame to be moved between its assembled position and its folded position.

Obviously, the frame must include at least three lengths of tubing. Preferably, the frame consists of six lengths of tubing to form six sides, and thus six connectors.

When the frame consists of six lengths of tubing, preferably the first length of tubing and the fourth length of tubing are of the same length and the second length of tubing, the third length of tubing, the fifth length of tubing and the six length of tubing are of the same length.

Preferably, the frame includes six lengths of tubing and in the assembled position of the frame, the angles between the first and second tenths of tubing, the fourth and third lengths of tubing, the first and sixth lengths of tubing and the fourth and fifth lengths of tubing are equal, more preferably 90 degrees, and the angles between the second and third lengths of tubing and the fifth and sixth lengths of tubing are equal.

The connector may be a spherical solid or hollow ball with a passage therethrough for the tensioning means.

Preferably, the connector includes two recesses, each recess being designed to receive an end of a length of tubing to hold it in its desired position for the assembled position of the frame.

The two recesses may be identical or different. For example one recess may be designed to receive an end of a length of tubing, which is fastened in position in the recess, while the other recess may be designed releasably to receive an end of a length of tubing, so that the frame may be moved to its folded position.

Alternatively the connector may comprise first and second connector elements securable to the first end of a length of tubing and the second end of an adjacent length of tubing respectively, each connector element comprising a body having an aperture therein through which the tensioning means can pass, thereby to age the connector elements together, the body of the first connector element defining a hinge formation and the body of the second connector element defining a complemental hinge formation, the hinge formations being mutually engagable to allow relative pivotal movement of the connector elements between an engaged condition in which the connector elements hold the respective lengths of tubing at the first angle to each other in the assembled position of the frame and a disengaged condition in which the lengths of tubing are movable relative to each other.

The first connector element may comprise a cup or socket and the second connector element may comprise a head shaped to be received in the cup or the socket.

The hinge formation defined by the body of the first connector element may be a groove extending around the cup or socket, and the complemental hinge formation defined by the body of the second connector element may be a bead extending around the head and shaped to be received in the groove.

The tensioning means may be a continuous cord passing through all of the lengths of tubing and the connectors, the cord being tensioned to hold the lengths of tubing and the connectors in position in the assembled position of the frame and the cord being sufficiently elastic to permit the frame to be moved between its assembled position and its folded position.

The cord may be an elasticated cord, in which case the elastic nature of the cord provides the tensioning and the elasticity.

Alternatively, the cord may be a non-elastic cord and may include in its length a tension spring.

Alternatively, the frame may include several tensioning means, each tensioning means operating either between a single pair of adjacent lengths of tubing or between two or more pairs of adjacent lengths of tubing.

In this case each tensioning means may comprise a spring or an elastic cord or a combination of a spring and an elastic or non-elastic cord, attached internally to the lengths of tubing or to the connectors so as to operate either between a single pair of adjacent lengths of tubing or between two or more pairs of adjacent lengths of tubing.

The frame preferably includes tension adjustment means for adjusting the tension of the tensioning means, i.e. to increase the tension to hold the lengths of tubing and the connectors in position in the assembled position of the frame and to decrease the tension to permit the frame to be moved between its assembled position and its folded position.

For example, a combination of a tensioning means and a tension adjustment means, operating between two pairs of adjacent lengths of tubing may comprise:

a first cord attached internally to a first length of tubing or to a first connector between the first length of tubing and a second adjacent length of tubing; a first roller in the first connector, the first cord passing over the roller; a spring located in the second length of tubing, the free end of the first cord being attached to a first end of the spring; a second cord having one end attached to a second end of the spring; a second roller in a second connector between the second length of tubing and a third adjacent length of tubing, the second cord passing over the second roller; a first pulley in the third length of tubing, the free end of the second cord being attached to the first pulley; a second pulley spaced from the first pulley and attached internally to the third length of tubing; a third cord attached internally to the third length of tubing and passing over the first and second pulleys, with the free end of the third cord passing out of the third length of tubing to enable it to be gripped to increase or decrease the tension on the tensioning means.

The system may include a cleat on the exterior or interior of the third length of tubing or on a connector releasably to hold the free end of the third cord.

Alternatively, a combination of a tensioning means and tension adjustment means operating between pairs of adjacent lengths of tubing may comprise:

a first cord attached internally to a first length of tubing or to a first connector between the first length of tubing and a second adjacent length of tubing; a first roller in the first connector, the first cord passing over the first roller; a spring located in the second length of tubing, the free end of the first cord being attached to a first end of the spring; a first pulley in the second length of tubing attached to a second end of the spring; a second pulley spaced from the first pulley in the second length of tubing and attached to the second length of tubing; a second cord attached internally to a third length of tubing adjacent the second length of tubing or to a second connector between the third length of tubing and the second length of tubing; a second roller in the second connector, the second cord passing over the second roller, the second cord then passing over the first and second pulleys, with the free end of the second cord passing out of the second length of tubing to enable it to be Ripped to increase or decrease the tension on the tensioning means.

Again, the system may include a cleat on the exterior or interior of the second length of tubing or on a connector releasably to hold the free end of the second cord.

As stated above, preferably, the frame consists of six lengths of tubing and thus three tensioning means, each tensioning means operating between two adjacent pairs of adjacent lengths of tubing.

The frame may be designed to support a covering such as a net to form a goalpost or the like, or a length of plastic, canvas or other suitable material to form a tent.

According to a second aspect of the invention there is provided a goalpost comprising a frame having six sides as described above and a net on the frame.

DESCRIPTION OF EMBODIMENTS

Figure 1:
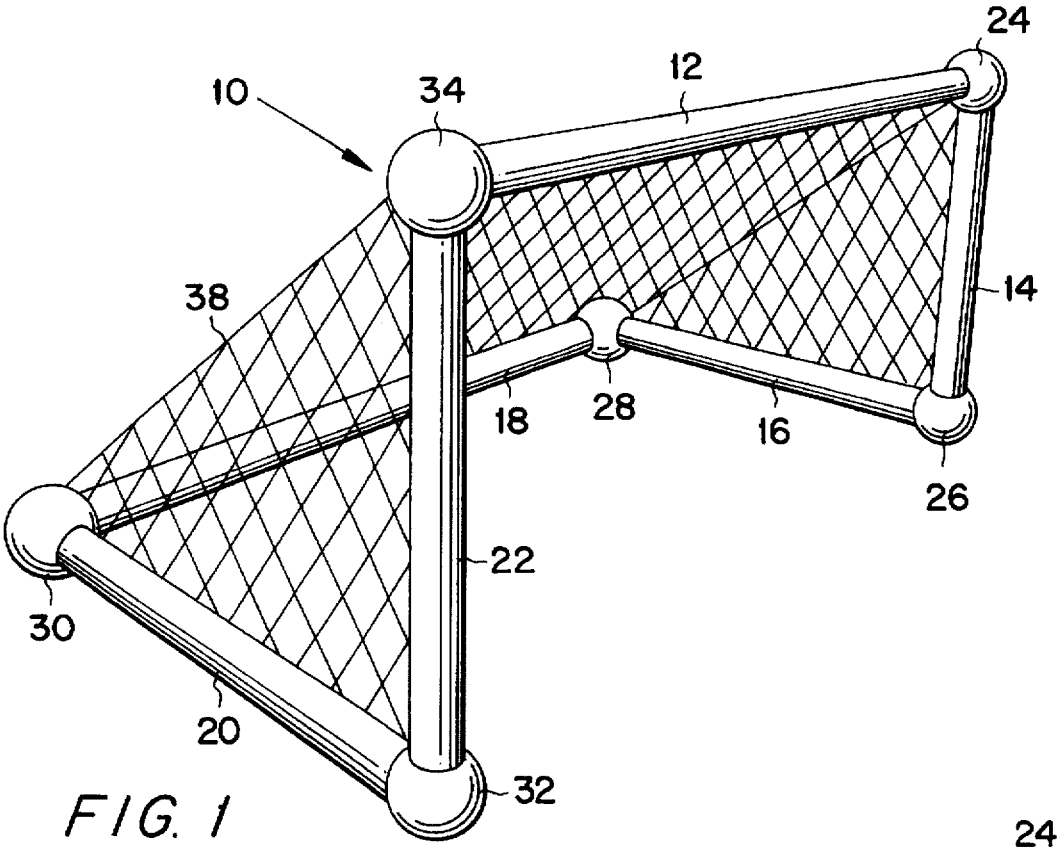
FIG. 1 is a perspective view of a first frame according to the invention in its assembled position.
Figure 2:
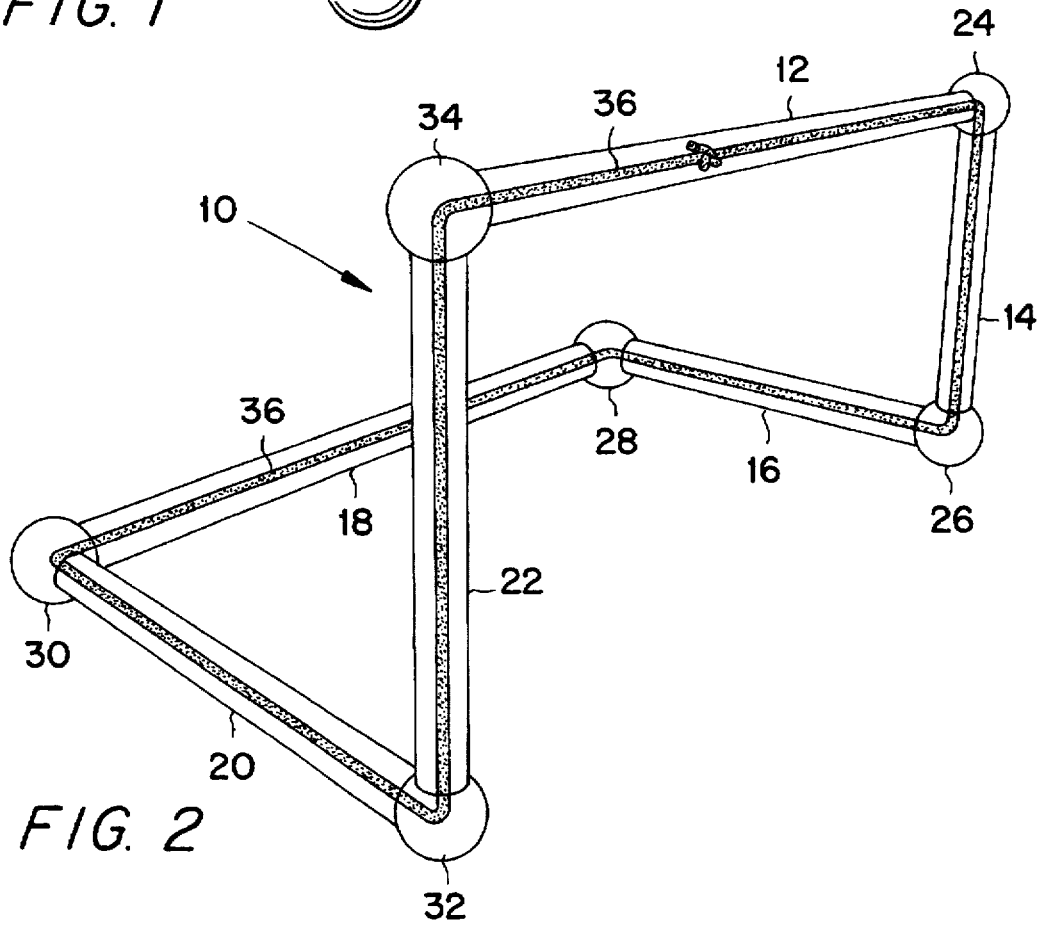
FIG. 2 is a perspective view of the frame of FIG. 1 illustrating the interior of the lengths of tubing.

Referring to FIGS. 1 and 2 there is shown a frame 10 which is designed to be used as a goalpost, which consists of six lengths of tubing 12, 14, 16, 18, 20 and 22, and six connectors 24, 26, 28, 30, 32 and 34. Located inside and passing through all of the lengths of tubing 12 to 22 and the connectors 24 to 34 is a continuous elasticated cord 36, as illustrated in FIG. 2.

The lengths of tubing 12 to 22 may be made of any suitable material such as a suitable plastics material, for example PVC or ABS, or a suitable metallic material, optionally sheathed with a protective covering such as a foam material.

Like,vise, the connectors 24 to 34 may be formed of any suitable material such as a suitable plastics material or wood or the like.

The continuous elasticated cord 36 may be any suitable elasticated rope or cord which has the required degree of tension and elasticity.

Figure 4:
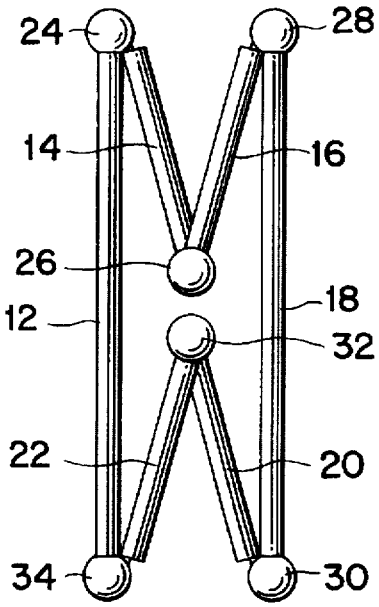
FIG. 4 is a view of the frame of FIG. 1 in its folded position.

In FIGS. 1 and 2, the frame 10 is illustrated in its assembled position. In this position, adjacent lengths of tubing, for example the length of tubing 12 and the length of tubing 14, are arranged at an angle to each other, the connector 24 being designed releasably to hold the lengths of tubing 12, 14 at this angle. When it is desired to move the frame 10 to its folded position, as illustrated in FIG. 4, the lengths of tubing 12 to 22 are pulled away from their respective connectors 24 to 34 and are moved to positions where all the lengths of tubing 12 to 22 lie substantially adjacent to each other. In this position, the frame 10 may easily be packed away for storage.

It can be seen that the frame 10 in FIG. 1 is covered by a net 38 so that it may be used as a goalpost. The net 38 may be attached to the frame 10 in any suitable manner. For example, the net 38 may be sewed onto the frame 10. Alternatively, the frame 10 may include a plurality of rings on the lengths of tubing 12 to 22, each ring bearing a hook, the net 38 being attached to the frame 10 by means of the hooks. Further alternatively, the net 38 may include sleeves along its edges, and the sleeves may slide over the various lengths of tubing 12 to 22 to attach the net 38 to the frame 10. Further alternatively, the net 38 may be welded on to the frame 10, using for example sonic welding.

Figure 3:
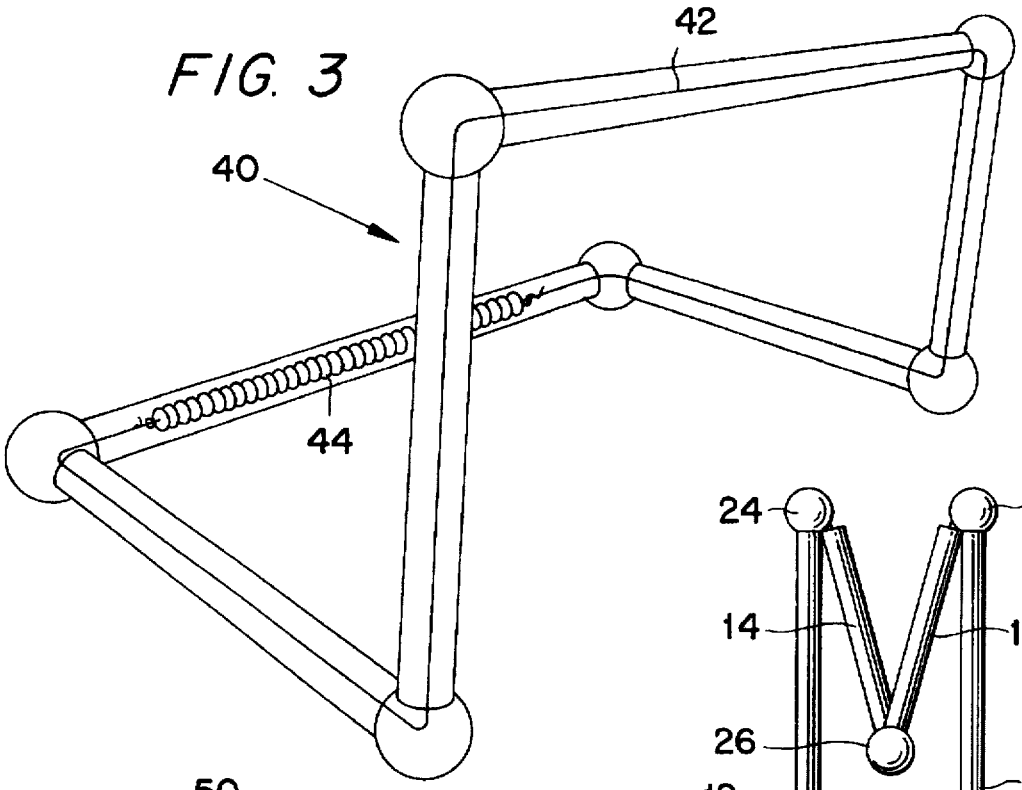
FIG. 3 is a perspective view of a second frame of the invention illustrating the interior of the lengths of tubing.

Referring to FIG. 3, there is shown a second frame 40 which is identical to the frame 10 of FIGS. 1 and 2 except that the elasticated cord 36 is replaced by a cord 42 which is non-elastic and which includes in its length a tension spring 44. The tension spring 44 provides the required degree of tensioning to hold the frame 40 in its assembled position and also includes the required degree of elasticity to allow for the frame 40 to be moved to its folded position (as illustrated in FIG. 4).

If required, the cord 42 may include more than one tension spring.

Figure 5:
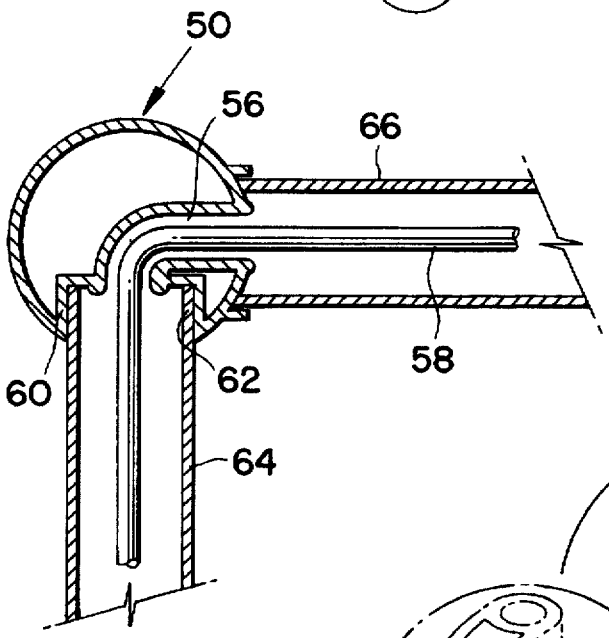
FIG. 5 is a sectional side view of a connection between a first length of tubing and a second length of tubing; using a first connector.
Figure 6:
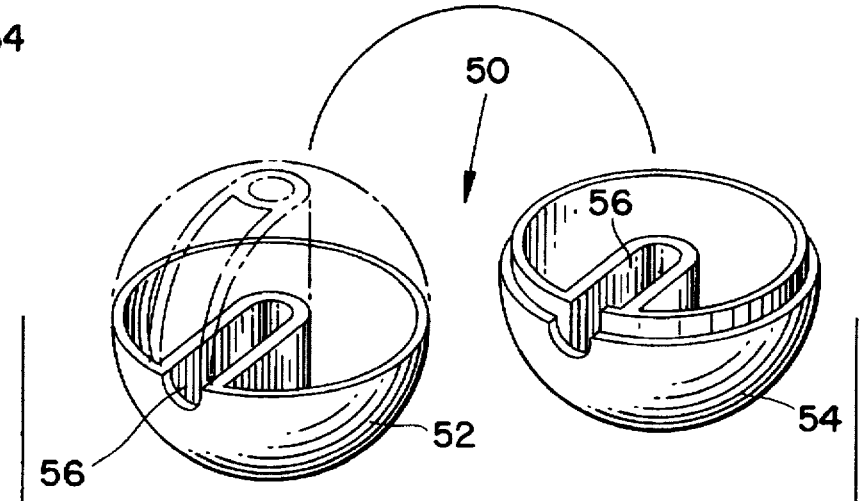
FIG. 6 is an exploded view of the connector of FIG. 5.

Referring to FIGS. 5 and 6 there is illustrated a first connector 50 for use in the frame 10 or the frame 40. The connector 50 is a spherical ball which is formed from two halves 52, 54. Generally, the connector 50 will be made of a suitable plastics material and will be formed by for example injection moulding, with the two halves 52, 54 then being joined to each other by sonic or solvent welding or by means of a suitable clip mechanism. Alternatively, the connector 50 may be blow moulded in one piece. The connector 50 includes a passage 56 therethrough for a cord 58.

The connector 50 also includes two recesses, one recess 60 being clearly illustrated in FIG. 5, each recess being designed to receive an end 62 of a length of tubing 64 to hold the length of tubing 64 in its correct position in the assembled position of the frame 10, 40. The end 62 of the length of tubing 64 is fastened in the recess 60. The end of the length of tubing 66 is releasably located in the other recess in the connector 50 so that when it is desired to move the frame 10, 40 to its folded position, the end of the length of tubing 66 is pulled out of the recess in the connector 50 so that the length of tubing 66 may be moved to its folded position. The elasticity of the cord 58 permits this to happen.

When the frame 10, 40 is designed to be used as a goalpost, the lengths of tubing forming the frame 10, 40 are preferably made of a suitable plastics material such as PVC or ABS and preferably have an outside diameter of 36 mm with a wall thickness of 2 to 2,5 mm. Further, when the frame 10, 40 is designed to be used as a goalpost, the length of tubing 12 and the length of tubing 18 preferably have a length of 1,5 m while the lengths of tubing 14, 16, 20, 22 preferably have a length of 1 m. This provides a goalpost of a suitable size for use by children.

The frame 10, 40 of the invention may also be used as a frame for a tent, in which case the frame 10, 40 may be covered by a suitable length of canvas or a plastics material or the like.

Figure 8:
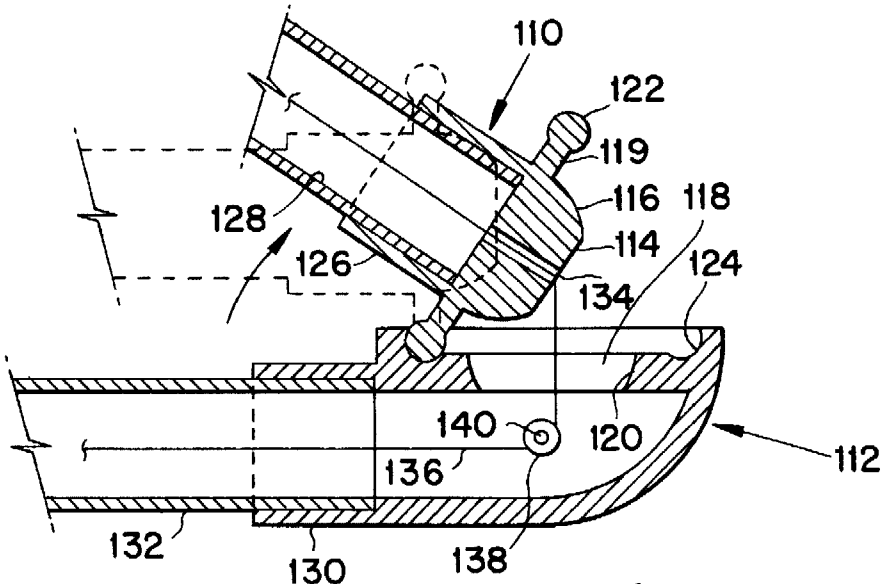
FIG. 8 is a sectional side view of the connector of FIG. 7 in a disengaged condition.
Figure 9:
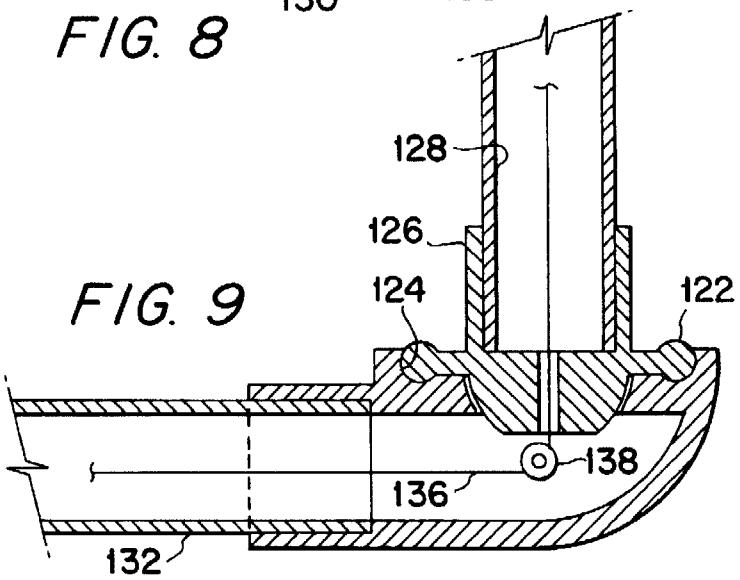
FIG. 9 is a similar view to that of FIG. 8, showing the connector in a fully engaged condition.
Figure 7:
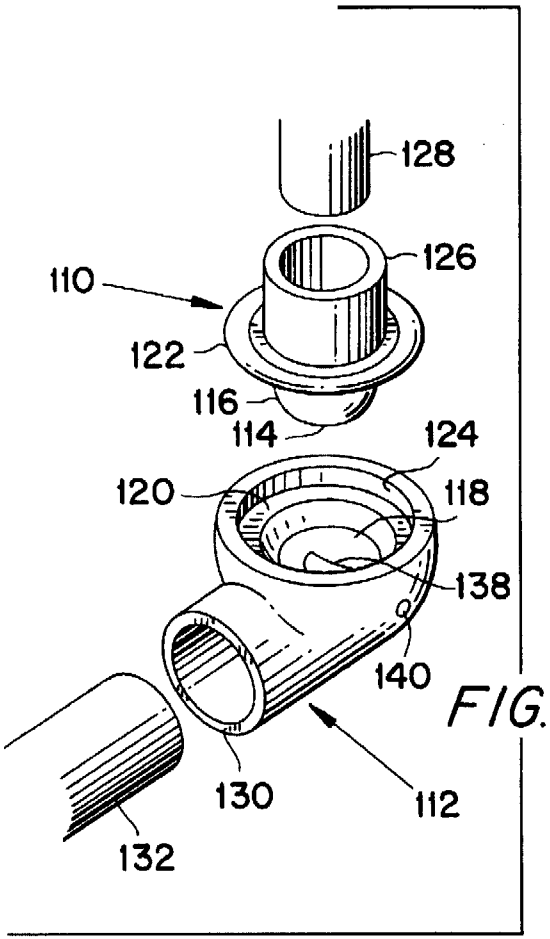
FIG. 7 is an exploded pictorial view of a second connector of the invention.

Referring to FIGS. 7 to 9 there is illustrated a second connector which comprises a first, male connector element 110 and a second, female connector element 112 which are both conveniently moulded from a tough plastics material or the like. The male connector element 110 has a tapered head 114 with a part-spherical peripheral support surface 116, while the female connector element 112 defines a cup or socket 118 which has a complementally curved part-spherical support surface 120.

Extending around the base of the head 114 is a flange 119, at the outer edge of which is formed an enlarged bead 122 of circular section. Extending around the cup or socket 118 of the female connector element 112 is a complementally shaped groove 124, in which the bead 122 can be received, as best seen in FIGS. 8 and 9.

The rearmost portion of the male connector element 110 defines a tubular socket 126 which receives one end of a tube 128 snugly. Similarly, a socket 130 in the female connector element 112 receives one end of a tube 132. A central, axially extending through-bore 134 is formed in the head 114 of the male connector element 110, and is sized to allow tensioning means such as a nylon cord or rope 136 to pass freely therethrough. A guide element in the form of a pulley or roller 138 supported on a pin 140 is located in the interior of the female connector element 112, and maintains the rope or cord 136 in alignment in use, allowing it to move freely in an axial direction despite the 90° range of movement of the joint.

The lengths of tubing 128, 132 may be ribbed on their outside surfaces with corresponding depressions on the inner mating surfaces of the sockets 126, 130, suitably shaped to receive these ribs to prevent rotation between the lengths of tubing 128, 132 and sockets 126, 130, when fitted together.

Figure 10:
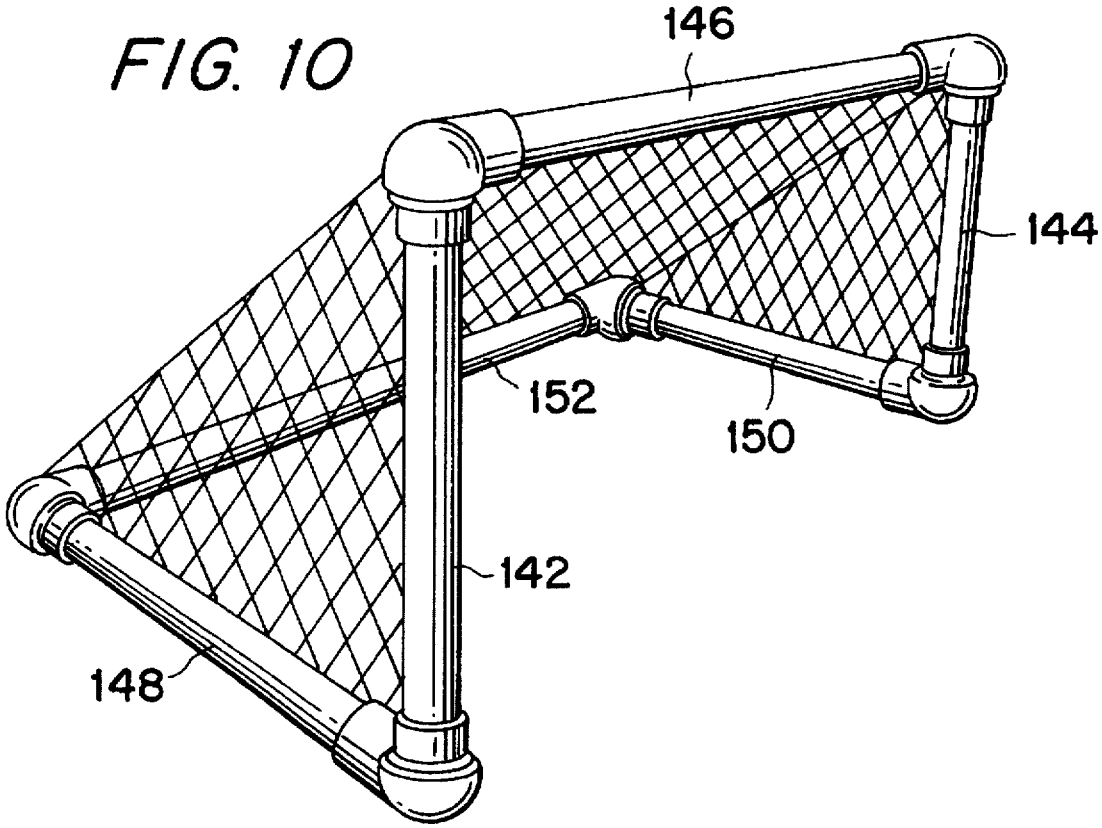
FIG. 10 is a pictorial view of a collapsible goal assembly using the connector of FIGS. 7 to 9.
Figure 11:
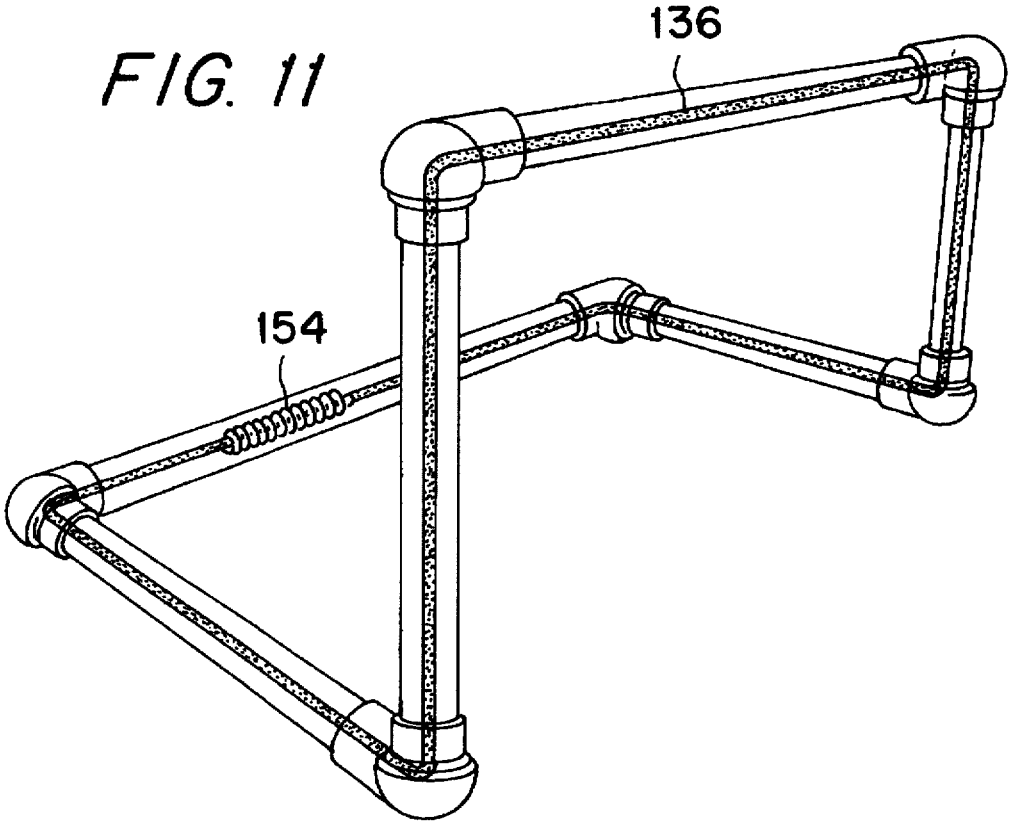
FIG. 11 is a similar view to that of FIG. 10, showing the arrangement of tension means in the assembly.

In the embodiment illustrated in FIGS. 10 and 11, a number of connectors of the invention are used in a collapsible goal assembly which comprises six lengths of tubing, with adjacent ends of the length of tubing terminating in the connector elements of the invention. The goal assembly comprises a pair of uprights 142 and 144, a cross-bar 146, a pair of rearwardly extending base elements 148 and 150, and a transverse base element 152. The uprights 142 and 144 have male connector elements 112 at each end, while the cross-bar 146 and the transverse base element 152 have female connector elements 112 at each end. The rearwardly extending base elements 148 and 150 each have a male connector element at one end and a female connector element at the other end.

Running within the tubes of the goal assembly, through the connectors, is the cord or rope 136, the ends of which are secured by cleats to opposite ends of a coil spring 154, which is held in a predetermined state of tension. The tension is sufficient to urge the connectors into an erect or engaged condition and to maintain them in that condition against moderate moments. However, if a strong moment is applied, due to a child running into an upright of the goal assembly, for example, the relevant connectors will give way and collapse.

The distance between the end of the through-bore 134 in the head 114 of the male connector element 110 and the pivot point defined between the bead 122 and the groove 124 of the socket 118 determines the length of a lever on which the force exerted by the tension element acts. The length of the lever is sufficient, in conjunction with the force exerted by the spring 154 via the tension element 136, to move the male and female connector elements into an engaged condition, together with their associated tubes 128 and 132. This enables easy setting up of the described goal assembly, or any other structure employing the connectors.

The spring 154 is preferably chosen so that it does not need to be stretched more than 1⅓ times its unstressed length in use.

Due to the hinge action between the bead 122 and the groove 124 of the male and female elements, a positive alignment between the male and female connector elements is maintained even when they are in a disengaged condition. The force applied by the tension element 136 is chosen to be sufficiently great to prevent easy dislodgement of the hinge formations in normal use. Even if these hinge formations do disengage, the design of the complementary sections 114/118, 116/120 and 122/124, will ensure that the joint re-engages in the correct position.

Instead of an inextensible rope or other tension element used in conjunction with one or more springs or the like, a resilient tension element could be used.

It will be apparent that the exact shape and configuration of the hinge elements can vary. In the illustrated embodiment (FIGS. 10 and 11), a pivotal movement of approximately 90° was required, to allow collapsing of the goal assembly into a state in which its tubing sections are arranged side-by-side for easy storage and carrying. In other applications, a greater or lesser range of movement might be required. Also, the illustrated embodiment of the connector of the invention permits relative pivoting motion of the connector elements through 360°, due to the circular shape of the bead 122 and the groove 124. However, in some applications, it might be unnecessary to allow such a wide range of movement, and the complemental hinge formations might be linear or part-circular, for example. Finally, it will be appreciated that the orientation of the socket or other securing formations on the socket for receiving a tube or other member need not be exactly as described.

Figure 12:
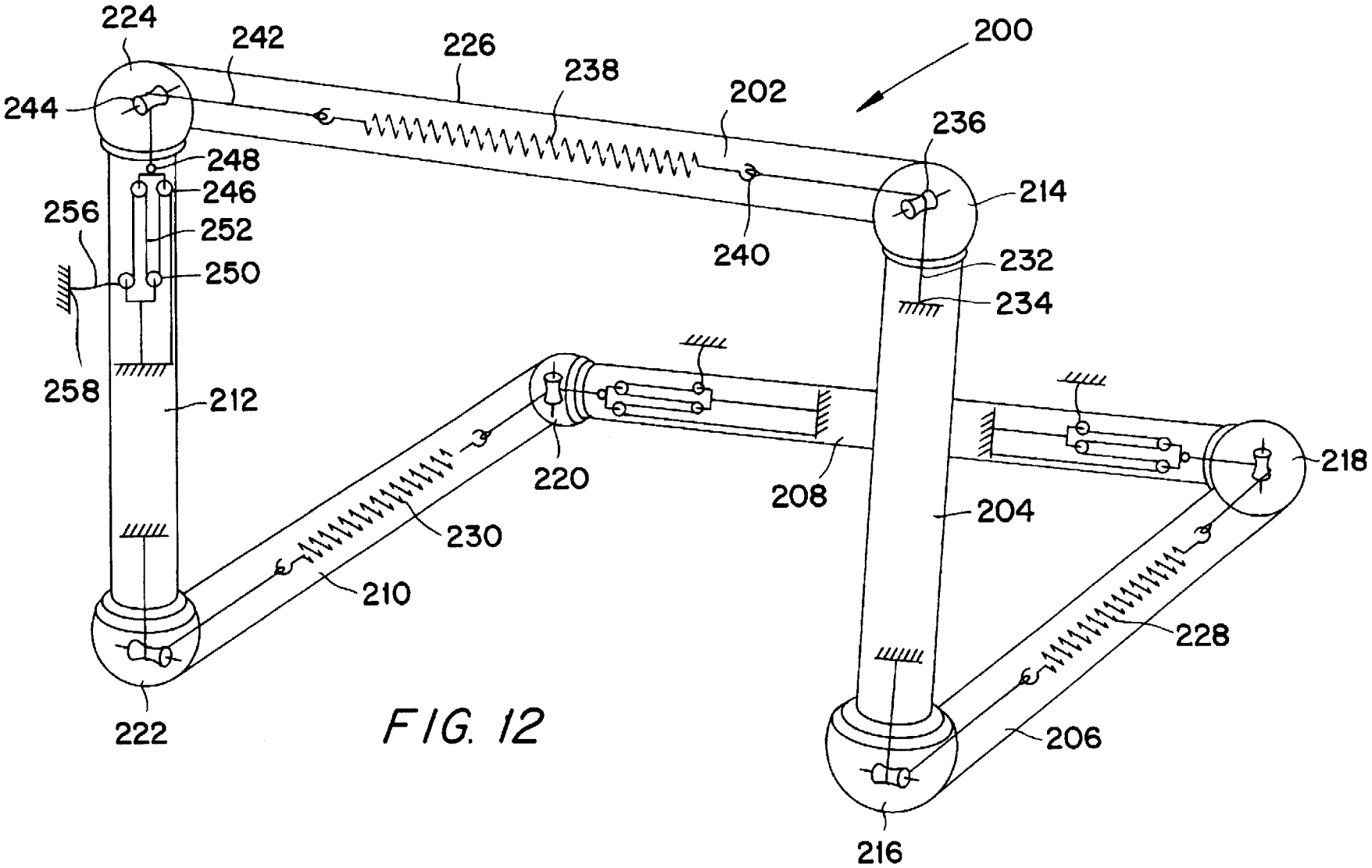
FIG. 12 is a schematic perspective view of a further frame according to the invention, accommodating a third tensioning means.
Figure 13:
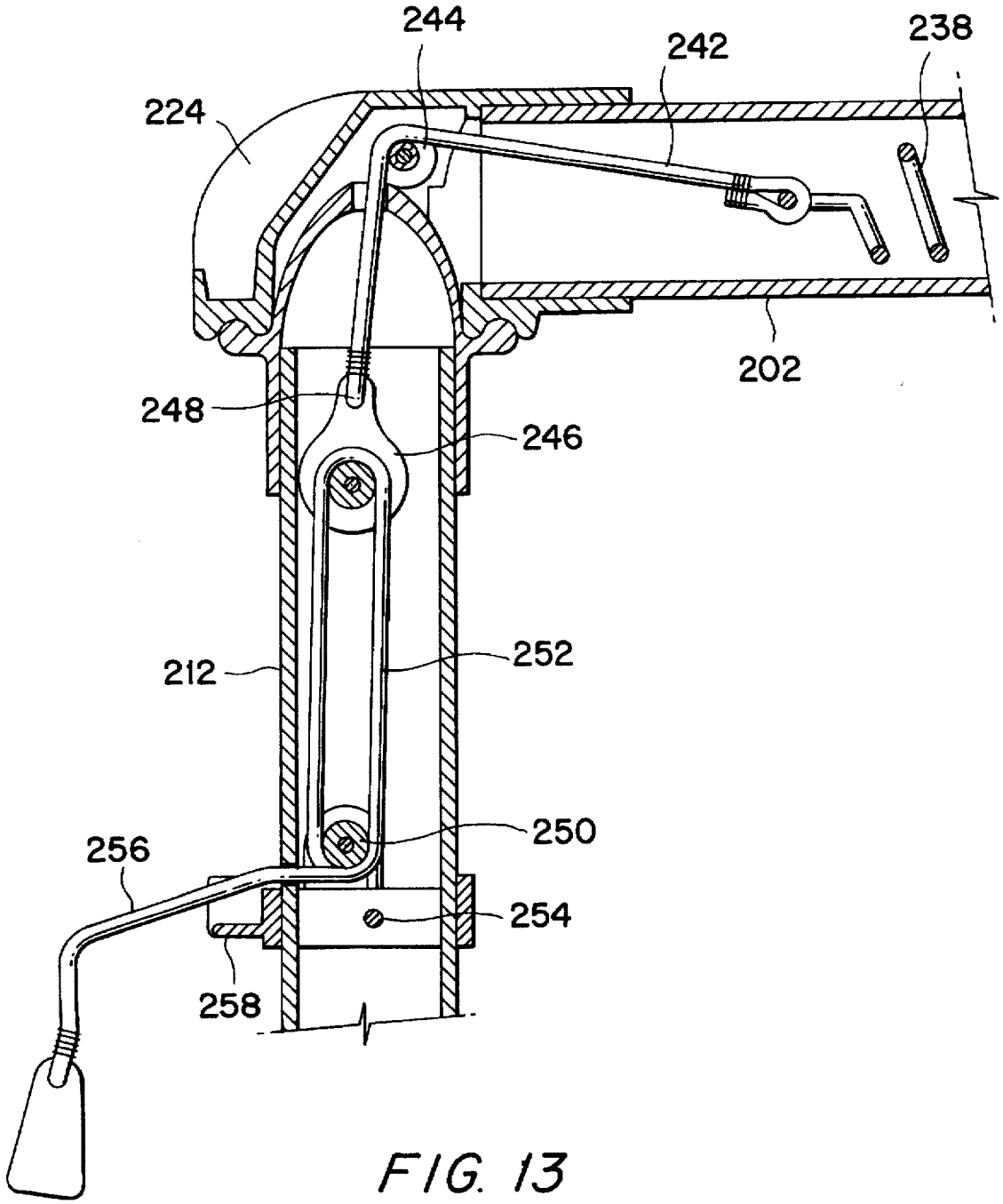
FIG. 13 is a schematic sectioned view of the tensioning means of FIG. 12.

Referring to FIGS. 12 and 13 there is shown a frame 200 which is designed to be used as a goalpost, which consists of six lengths of tubing 202, 204, 206,208,210 and 212, and six connectors 214, 216, 218, 220,222 and 224. Located inside the lengths of tubing 202 to 2 12 are three identical tensioning means 226, 228, 230, the tensioning means 226 being illustrated in FIG. 13.

The lengths of tubing 202 to 212 and the connectors 214 to 224 may be as described in FIGS 1 to 6 or 7 to 11.

The tensioning means 226 will now be described. The tensioning means 226 comprises a first cord 232 attached internally at 234 to the length of tubing 204. A first roller 236 is located in the connector 214, with the cord 232 passing over the roller 236. A spring 238 is located in the length of tubing 202, the free end 240 of the cord 232 being attached to a first end of the spring 238. Attached to a second end of the spring 238 is a second cord 242 which passes over a second roller 244 in the connector 224. Located in the length of tubing 212 is a first pulley 246 to which is attached the free end 248 of the cord 242, and a second pulley 250 attached internally to the length of tubing 212. A third cord 252 attached internally to the length of tubing 212 at 254, passes over the first and second pulleys 246, 250. The free end 256 of the cord 252 passes out of the length of tubing 212 to enable it to be gripped by a user of the frame to increase or decrease the tension on the tensioning means 226. The end of the cord 256 may be held in position by a cleat 258 or the like.

The use of the tensioning means 226 will now be described. When it is designed to use the frame 200 in its assembled position as shown in FIG. 12, the cord 252 is gripped by means of its end 256 and is pulled to increase the tension on the cord 252 and thus on the cord 242, the spring 238 and the cord 232 to hold the lengths of tubing 202 to 212 and the connectors 214, to 224 firmly together in the assembled position of the frame 200.

When it is desired to release the tension, the end 256 of the cord 252 is removed from the cleat 258 and is allowed to move backwards into the length of tubing 212 to release the tension on the cord 252, the cord 242, the spring 238 and the cord 232, so that the frame 200 may be moved from its assembled position into its folded position.

Figure 14:
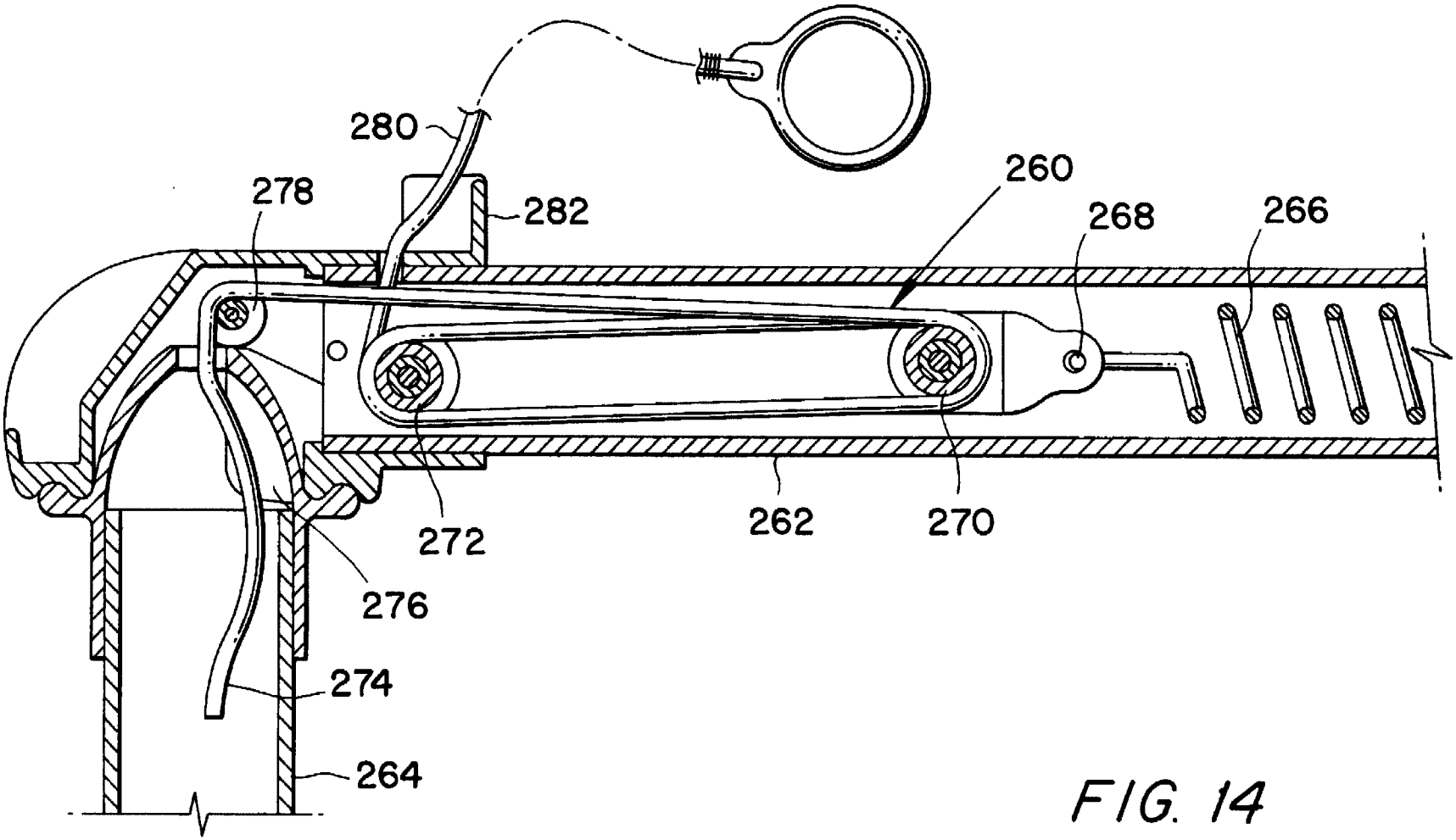
FIG. 14 is a schematic sectioned view of a fourth tensioning means of the invention.

Referring to FIG. 14 there is shown an alternative tensioning means 260 between three lengths of tubing, only two of which are shown, viz. lengths 262 and 264. The first element of the tensioning means 260 is a spring 266. The end of the spring 266 not shown is attached to a cord which passes over a roller, the free end of the cord being attached internally to the length of tubing not shown, as is illustrated for the tensioning means 226 in FIG. 12.

An end 268 of the spring 266 is attached to a pulley 270. Spaced from the pulley 270 is a second pulley 272. A cord 274 is attached internally to the length of tubing 264 by means of a cleat 276. The cord 274 passes over a roller 278 and then around the pulleys 272, 270. The free end 280 of the cord 274 passes out of the length of tubing 262 to enable it to be gripped by a user of the frame to increase or decrease the tension on the tensioning means 260. The free end 280 of the cord 274 may be held in position by means of a cleat 282 or the like.

The tensioning means 260 operates in the same manner as the tensioning means 226 described above.

It is to be noted, that although not illustrated, the connectors of the frame may each be covered by a flexible sock or boot to prevent a user of the frame from getting a digit or other part of the body trapped by a connector in use of the frame, and to prevent dirt from getting into or onto the connectors.

The frame of the invention has the advantage that it may be moved between an assembled position in which it functions as a goalpost frame or a tent frame or the like and a folded position in which the various elements of the frame are located side by side in a compact manner so that the frame does not take up much room on storage. Further, the frame when designed to be used as a goalpost, is so designed that should a child or an adult fall against the frame, it will bend and thus avoid causing injury to the child or adult.

We claim:

1. A frame movable between an assembled position and a folded position comprises:

a number n of lengths of tubing, each length of tubing having a first end and a second end, the second end of the first length of tubing being connected to the first end of the second length of tubing, the second end of the second length of tubing being connected to the first end of the third length of tubing and so on with the second end of the nth length of tubing being connected to the first end of the first length of tubing to form a closed circuit, each length of tubing forming a side of the frame;

a connector between each of the first end of a length of tubing and the second end of an adjacent length of tubing, the connectors being adapted to permit two adjacent lengths of tubing to be arranged at a first angle to each other in the assembled position of the frame and at a second angle to each other in the folded position of the frame; and tensioning means between each pair of adjacent lengths of tubing adapted to hold the lengths of tubing and the connectors in position in the assembled position of the frame and to permit the frame to be moved between its assembled position and its folded position; wherein each connector comprises a first connector element comprising a cup or a socket and a second connector element comprising a head shaped to be received in the cup or the socket, the first and second connector elements being securable to the first end of a length of tubing and the second end of an adjacent length of tubing respectively, each connector element comprising a body having an aperture therein through which the tensioning means can pass, thereby to urge the connector elements together, the body of the first connector element defining a hinge formation and the body of the second connector element defining a complemental hinge formation, the hinge formations being mutually engageable to allow relative pivotal movement of the connector elements between an engaged condition in which the connector elements hold the respective lengths of tubing at a first angle to each other in the assembled position of the frame and a disengaged condition in which the lengths of tubing are movable relative to each other.

2. A frame according to claim 1, wherein said frame consists of six lengths of tubing to form six sides of the frame, and six connectors, the first length of tubing and the fourth length of tubing being of the same length and the second length of tubing, the third length of tubing, the fifth length of tubing and the sixth length of tubing being of the same length, and the angles between the first and second length of tubing, the fourth and third lengths of tubing, the first and sixth lengths of tubing and the fourth and fifth lengths of tubing being about ninety degrees, and the angles between the second and third lengths of tubing and the fifth and sixth lengths of tubing being equal.

3. A frame according to claim 2, wherein the frame is designed to support a net to form a goalpost.

4. A frame according to claim 1, wherein the hinge formation defined by the body of the first connector element comprises a groove extending around the cup or socket and the complemental hinge formation defined by the body of the second connector element comprises a bead extending around the head and shaped to be received in the groove.

5. A frame according to claim 1, wherein the tensioning means comprises a continuous cord passing through all of the lengths of tubing and the connectors, the cord being tensioned to hold the lengths of tubing and the connectors in position in the assembled position of the frame and the cord being sufficiently elastic to permit the frame to be moved between its assembled position and its folded position, the cord being selected from the group consisting of an elasticated cord in which the elastic nature of the cord provides the tensioning and the elasticity, and a non-elastic cord which includes in its length a tension spring.

6. A frame according to claim 1, wherein the frame includes several tensioning means, each tensioning means operating either between a single pair of adjacent lengths of tubing or between two or more pairs of adjacent lengths of tubing, each tensioning means comprising a spring or an elastic cord or a combination of a spring and an elastic or non-elastic cord, attached internally to the lengths of tubing or to the connectors so as to operate either between a single pair of adjacent lengths of tubing or between two or more pairs of adjacent lengths of tubing.

7. A frame according to claim 1, wherein the frame includes tension adjustment means for adjusting the tension of the tensioning means to increase the tension to hold the lengths of tubing and the connectors in position in the assembled position of the frame and to decrease the tension to permit the frame to be moved between its assembled position and its folded position.

8. A frame according to claim 7 wherein a combination of a tensioning means and a tension adjustment means, operating between two pairs of adjacent lengths of tubing comprises:

a first cord attached internally to a first length of tubing, a first connector between the first length of tubing and a second adjacent length of tubing; a first roller in the first connector, the first cord passing over the roller; a spring located in the second length of tubing, the free end of the first cord being attached to a first end of the spring; a second cord having one end attached to a second end of the spring; a second roller in a second connector between the second length of tubing and a third adjacent length of tubing, the second cord passing over the second roller; a first pulley in the third length of tubing, the free end of the second cord being attached to the first pulley; a second pulley spaced from the first pulley and attached internally to the third length of tubing; a third cord attached internally to the third length of tubing and passing over the first and second pulleys, with the free end of the third cord passing out of the third length of tubing to enable it to be gripped to increase or decrease the tension on the tensioning means.

9. A frame according to claim 7, wherein a combination of a tensioning means and a tension adjustments means, operating between pairs of adjacent lengths of tubing comprises:

a first cord attached internally to a first length of tubing, a first connector between the first length of tubing and a second adjacent length of tubing; a first roller in the first connector, the first cord passing over the first roller; a spring located in the second length of tubing, the free end of the first cord being attached to a first end of the spring; a first pulley in the second length of tubing attached to a second end of the spring; a second pulley spaced from the first pulley in the second length of tubing and attached to the second length of tubing; a second cord attached internally to a third length of tubing adjacent the second length of tubing between the third length of tubing and the second length of tubing;

a second roller in the second connector the second cord passing over the second roller, the second cord then passing over the first and second pulleys, with the free end of the second cord passing out of the second length of tubing to enable it to be gripped to increase or decrease the tension on the tensioning means.

10. A frame according to claim 7 wherein a combination of a tensioning means and a tension adjustment means, operating between two pairs of adjacent lengths of tubing comprises:

a first cord attached internally to a first connector between the first length of tubing and a second adjacent length of tubing; a first roller in the first connector, the first cord passing over the roller; a spring located in the second length of tubing, the free end of the first cord being attached to a first end of the spring; a second cord having one end attached to a second end of the spring; a second roller in a second connector between the second length of tubing and a third adjacent length of tubing, the second cord passing over the second roller; a first pulley in the third length of tubing, the free end of the second cord being attached to the first pulley; a second pulley spaced from the first pulley and attached internally to the third length of tubing; a third cord attached internally to the third length of tubing and passing over the first and second pulleys, with the free end of the third cord passing out of the third length of tubing to enable it to be gripped to increase or decrease the tension on the tensioning means.

11. A frame according to claim 7, wherein a combination of a tensioning means and a tension adjustments means, operating between pairs of adjacent lengths of tubing comprises:

a first cord attached internally to a first connector between the first length of tubing and a second adjacent length of tubing; a first roller in the first connector, the first cord passing over the first roller; a spring located in the second length of tubing, the free end of the first cord being attached to a first end of the spring; a first pulley in the second length of tubing attached to a second end of the spring; a second pulley spaced from the first pulley in the second length of tubing and attached to the second length of tubing; a second cord attached internally to a second connector between the third length of tubing and the second length of tubing; a second roller in the second connector the second cord passing over the second roller, the second cord then passing over the first and second pulleys, with the free end of the second cord passing out of the second length of tubing to enable it to be gripped to increase or decrease the tension on the tensioning means.

* * * * *